US008184131B2

(12) United States Patent
Huang et al.

(10) Patent No.: US 8,184,131 B2
(45) Date of Patent: May 22, 2012

(54) SYSTEM FOR DYNAMIC GAMMA CORRECTION OF NON-UNIFORM FREQUENCY CLOCKS AND METHOD THEREFOR

(75) Inventors: Chiao-Nan Huang, Hsinchu (TW); Chao-Chiun Liang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 756 days.

(21) Appl. No.: 11/707,918

(22) Filed: Feb. 20, 2007

(65) Prior Publication Data

US 2008/0111836 A1 May 15, 2008

(30) Foreign Application Priority Data

Nov. 10, 2006 (TW) ..... 95141795 A

(51) Int. Cl.
*G09G 5/10* (2006.01)

(52) U.S. Cl. ..... 345/690; 345/691; 345/99; 345/100; 345/204; 345/89; 348/671; 348/672; 348/674

(58) Field of Classification Search ..... 345/89, 345/63, 690, 77, 99–100, 204, 691; 348/671, 348/672, 674, 687, 790, 222.1
See application file for complete search history.

(56) References Cited

U.S. PATENT DOCUMENTS

| | | | | |
|---|---|---|---|---|
| 6,137,462 | A * | 10/2000 | Kim | 345/94 |
| 6,281,944 | B1 | 8/2001 | Kim | |
| 6,429,858 | B1 * | 8/2002 | Janssen et al. | 345/204 |
| 7,499,014 | B2 * | 3/2009 | Park | 345/99 |
| 2002/0126106 | A1 * | 9/2002 | Naito | 345/204 |
| 2004/0090402 | A1 | 5/2004 | Cheng | |
| 2004/0135778 | A1 * | 7/2004 | Sato et al. | 345/204 |
| 2005/0122287 | A1 * | 6/2005 | Nishitani et al. | 345/63 |
| 2007/0091021 | A1 * | 4/2007 | Uota | 345/63 |
| 2009/0251486 | A1 * | 10/2009 | Sakakibara et al. | 345/596 |

FOREIGN PATENT DOCUMENTS

| | | |
|---|---|---|
| TW | 454415 B | 9/2001 |
| TW | 564645 B | 12/2003 |

* cited by examiner

*Primary Examiner* — Lun-Yi Lao
*Assistant Examiner* — Priyank Shah
(74) *Attorney, Agent, or Firm* — Birch, Stewart, Kolasch & Birch, LLP

(57) ABSTRACT

A system for dynamic gamma correction of multi-scaled clocks and method therefor are provided, wherein multi-scaled clocks are applied to control the grayscale upon only one set of ramp voltage, so that the linearity of the gamma curve can be adjusted freely or to adjust the gamma correction strategy based on the image content or the user preference.

6 Claims, 9 Drawing Sheets

SYSTEM FOR DYNAMIC GAMMA CORRECTION OF NON-UNIFORM FREQUENCY CLOCKS AND METHOD THEREFOR

CROSS-REFERENCE TO RELATED APPLICATIONS

This non-provisional application claims priority under 35 U.S.C. §119(a) on Patent Application No(s). 095141795 filed in Taiwan, R.O.C. on Nov. 10, 2006, the entire contents of which are hereby incorporated by reference.

BACKGROUND

1. Field of the Invention

The invention relates to a system and a method for gamma correction, and more particularly to which apply a single ramp voltage to undertake a dynamic gamma correction of non-uniform frequency clocks and method therefor.

2. Related Art

Usually, a display doesn't generate luminance linearly. Therefore gamma curve correction is required in order to obtain the required luminance. In old days of CRT monitors, brightness (B) relates to the voltage generated by the electronic gun by being proportional to the gamma (γ) order of the voltage (Vs), which forms a famous γ-curve. At that time, signal transmitted by the TV station must correspond to this γ-curve, so that the brightness/darkness ratio and the color performance of the image can be correct. For the same reason, today's updated LCD monitor also needs to comply with the γ-curve.

In IT era, everything is standardized, including the γ-curve for a value of 2.2 or 2.4. However, people may feel differently about an image showed on TV. Different people may prefer different stronger, lighter, brighter or darker color performance with the same image, which means they may have their own γ value preference. And adjusting the γ-curve can produce different color and brightness performance.

Usually, details in a dark image hardly can be identified. Although brightness can be increased in whole to make the dark area more clear, the image may lose its reality. For example, the color of blue sky may fade. Hence, if the γ-curve is capable of changing in part, the contrast ratio can be increased by part of the brightness is corrected.

One method for a conventional LCD to adjust the γ-curve is using a resistor co-working with a buffer to divide the reference voltage to achieve the gamma correction. A plasma display panel is using a high voltage data driver and controlling the grayscale by applying a uniform counter clock to produce the required grayscale. The produced corresponding γ-curve is similar to an exponent curve therefore can not represent the real grayscale. Other methods for gamma correction include applying multiple ramp voltage waveforms or PWM.

U.S. Pat. No. 6,137,462 has disclosed a known gamma correction method, where a LCD driving circuit is disclosed. The main technical feature is to design multiple ramp voltages (ramp waveforms) based on the T-V curve, and co-works it with a counter by a ramp voltage (ramp waveform) selector, so the time for the input image data can be adjusted for selecting a voltage, which corresponds to the input data to achieve the brightness-voltage linear correction.

US published application US20040090402 has disclosed another known gamma correction method, where a method and an apparatus for gamma correction for displays are disclosed. The main technical feature is to undertake the gamma correction by co-working a produced non-linear ramp voltage (ramp waveform) with Supertex's HV623 driver IC.

US published application US20040135778 has disclosed another known gamma correction method, where a display is disclosed, and the gamma correction is proceeded by using a reference data generating circuit to determine the counting frequency by comparing the value of the counter and a predetermined value. The method uses a single ramp voltage (ramp waveform) and a predetermined multi frequency check table to determine whether to perform gray control by way of look up the table. This technique utilizes fixed, predetermined, and limited multi frequency to perform the gamma correction.

The forgoing mentioned brightness-voltage curves are all non-linear. Therefore a gamma correction is necessary to obtain rich and correct color. However, the circuit of conventional multi ramp voltage (ramp waveform) for gamma correction is complex and high cost. Besides, since a high bandwidth driver IC is necessary for a conventional PWM gamma correction, the cost and EMI are both high, either.

Therefore, utilizing single ramp voltage (ramp waveform) and non-uniform frequency clocks counter clock to control grayscale is probably a good way to cost down in design. The frequency of the counter clock can be calculated based on the curve slope of brightness-voltage in order to obtain a linear gamma curve. Since the frequency of the counter clock is obtained by calculation, it is non fixable and unlimited adjustable so the linearity of the gamma curve can be infinitely increased.

According to the forgoing problems, the invention provides a low cost and high performance solution.

SUMMARY OF THE INVENTION

According to the foregoing problems, the purpose of the invention is to provide a system for dynamic gamma correction of non-uniform frequency clocks and method therefor, which include a gamma slope calculation unit and a non-uniform frequency clocks counter clock calculation unit to correct a brightness-voltage non linear relationship for an image data of a display panel by the input of a ramp voltage and a counter clock.

The invention further provides a method for non-uniform frequency clocks calculation, which calculates a plurality gamma slopes with respect to different regions based on a brightness-grayscale relationship curve and then calculates a counter clock of non-uniform frequency clocks based on each gamma slope.

In practical, the invention is more suitable in offline or online adjustment, and is capable of adjusting based on the contents of the image. Since the number of frequency is unlimited, the linearity of gamma curve can be infinitely increased.

The invention not only can express the color of the image correctly, but also can adjust it by the user's preference or further enhance the quality of the image.

The features and practice of the present invention will be illustrated below in detail through preferred embodiments with reference to the accompanying drawings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The patent or application file contains at least one drawing executed in color. Copies of this patent or patent application publication with color drawing(s) will be provided by the office upon request and payment of the necessary fee.

The present invention will become more fully understood from the detailed description given below, which is for illustration only and thus is not limitative of the present invention, wherein.

DETAILED DESCRIPTION

Figure 1:
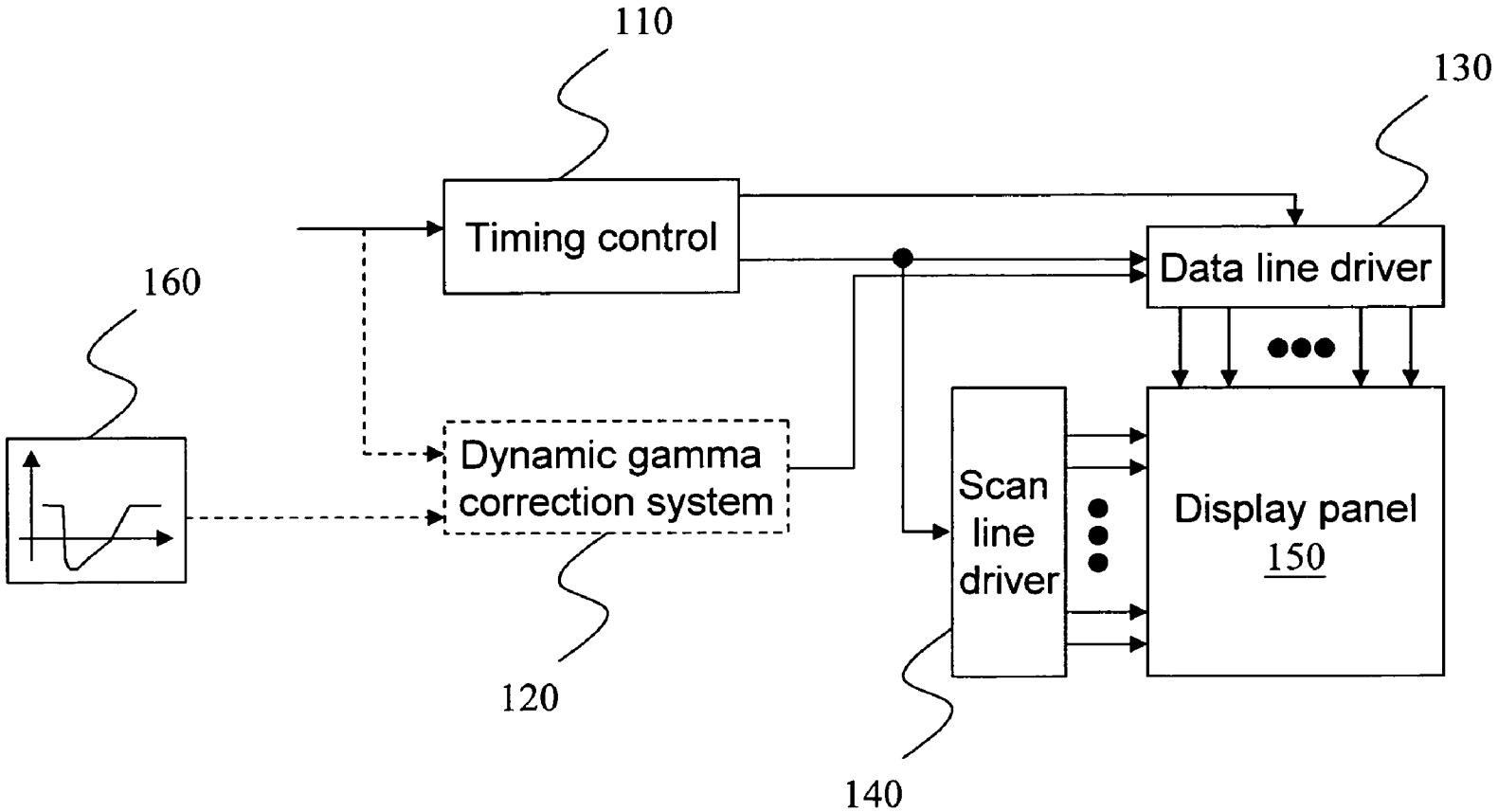
FIG.1 (Prior art)
FIG. 1 shows a block diagram of a conventional gamma correction circuit for a display panel.

FIG. 1 shows a conventional gamma correction circuit for a display panel, including a timing control 110, a dynamic gamma correction system 120, a data line driver 130, a scan line driver 140, a display panel 150 and a ramp voltage generating circuit 160. Specifically, the dynamic gamma correction system 120 provided in this invention is burned into the Field-Programmable Gate Array (FPGA) or application-specific integrated circuit (ASIC) with mechanic description language for the adoption of the presently used gamma correction circuit in the display panel 150. Therefore, additional design for the circuit is not necessary, so the manufacturing cost can be decreased. The display panel 150 can be a LCD panel or a plasma display panel.

Figure 2:
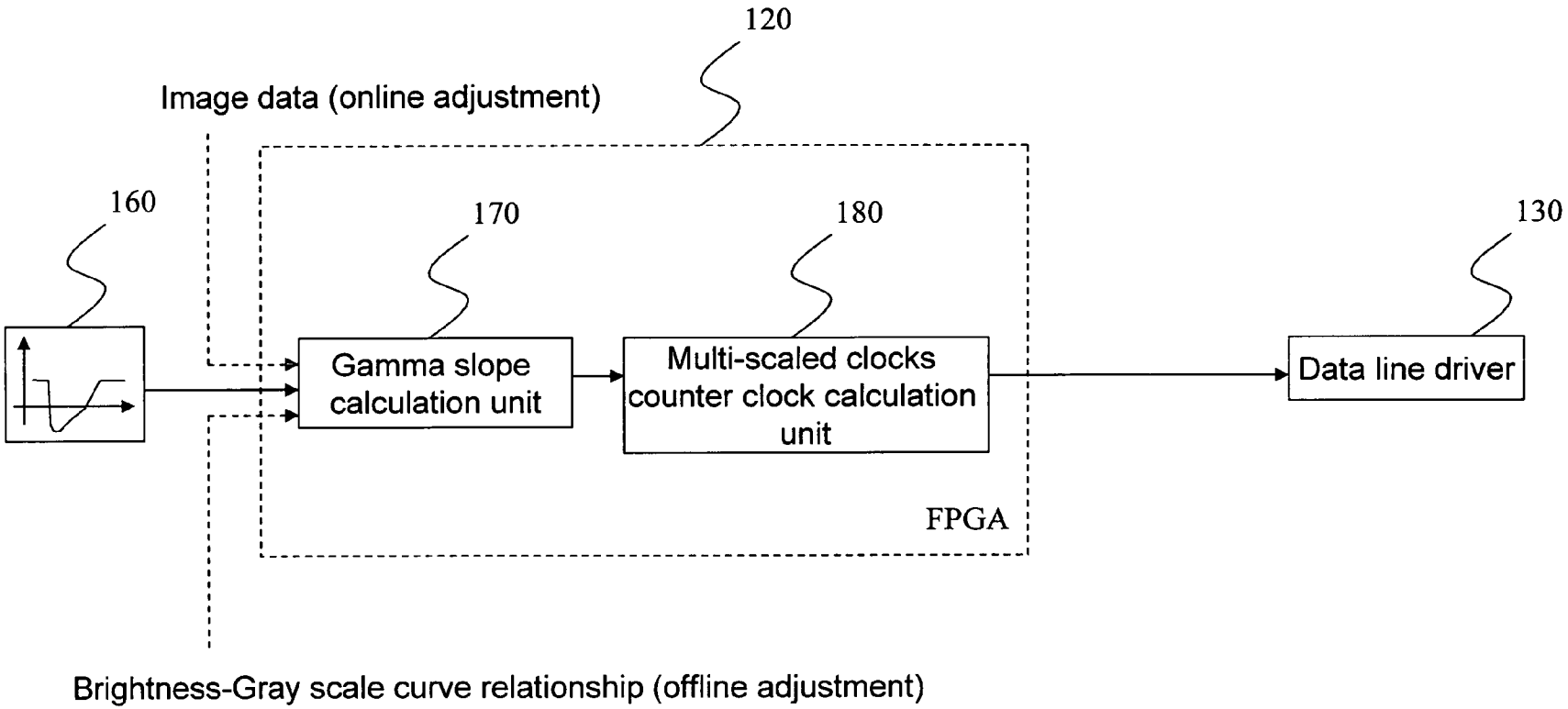
FIG. 2 shows a block diagram of an embodiment of the dynamic gamma correction system of the invention.

The technical feature of the invention is to dynamically correct the non-linear relationship of brightness-voltage by using a counter clock which is obtained by an output of calculating a ramp voltage from the dynamic gamma correction system 120, so that the curve relationship of brightness-grayscale can be proximate to linear to enhance the image quality. FIG. 2 shows a block diagram of an embodiment of the dynamic gamma correction system of the invention. The dynamic gamma correction system 120 further includes: a ramp voltage generating circuit 160 to provide a ramp voltage; a gamma slope calculation unit 170 to receive an image data and to calculate a plurality of gamma slopes with respect to different regions based on a brightness-grayscale relationship; a non-uniform frequency clocks counter clock calculation unit 180 to calculate a counter clock of non-uniform frequency clocks based on each gamma slope and then to input the ramp voltage and the counter clock to the data line driver 130 to correct the brightness-voltage non linear relationship for the image data.

Figure 3A:
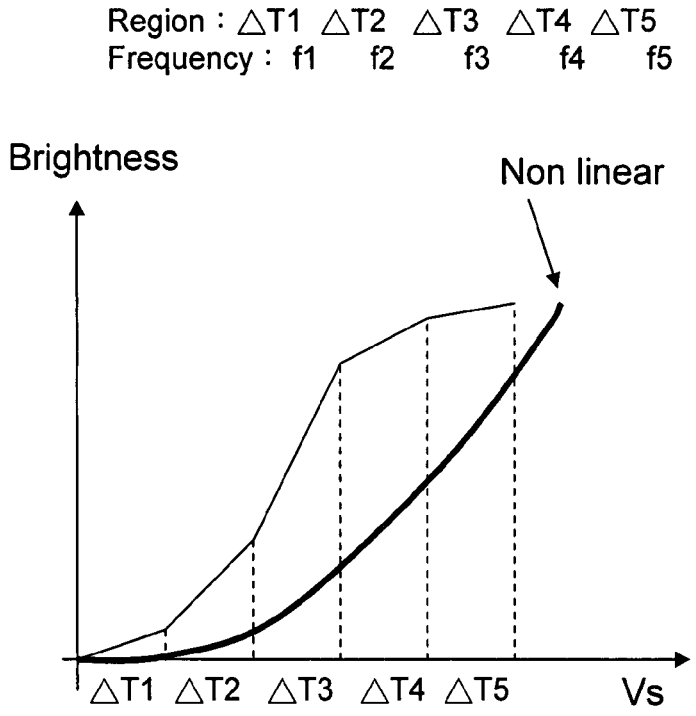
FIGS. 3A and 3B are diagrams respectively showing before and after the dynamic gamma correction of the invention.
Figure 3B:
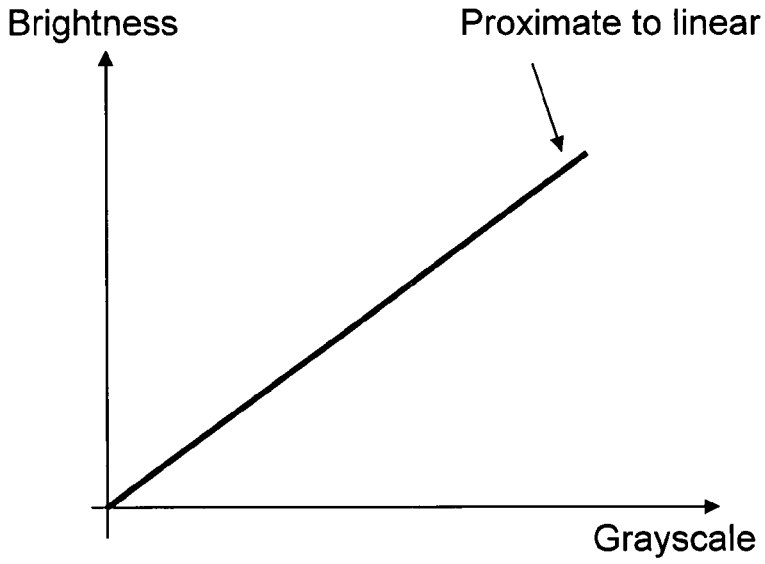

FIG. 3A and FIG. 3B are diagrams respectively showing before and after the dynamic gamma correction of the invention. The display panel in general has a non linear brightness-voltage relationship for the image data as shown in FIG. 3A; however, by the dynamic non-uniform frequency clock gamma correction of the invention, the brightness-grayscale curve relationship can be proximate to linear as shown in FIG. 3B. Therefore the color and brightness performance for the image data can be better. The methods to calculate the frequency for different regions will be described in the following paragraphs.

Figure 4A:
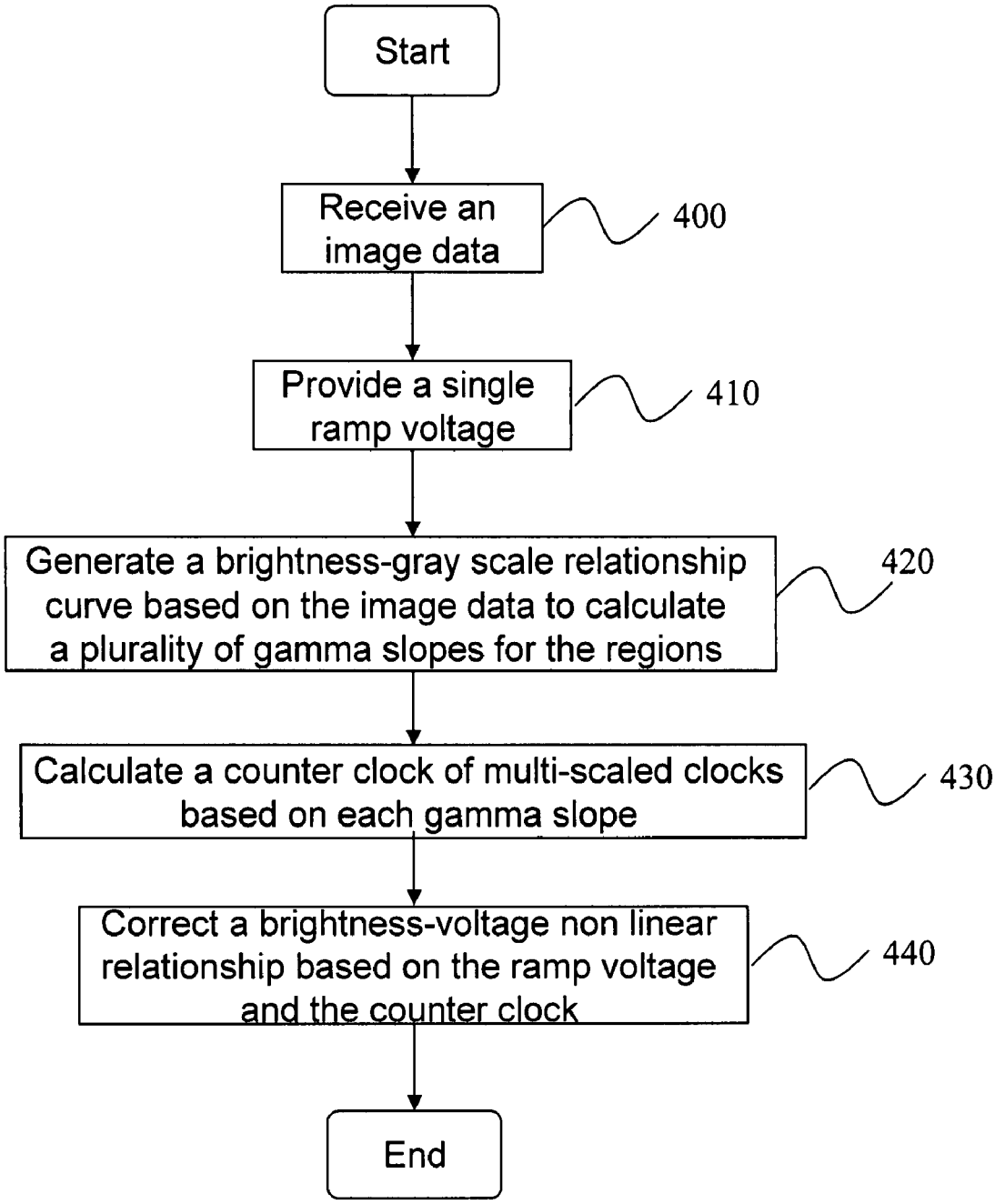
FIG. 4A shows a first embodiment of the method of the invention.

FIG. 4A shows a first embodiment of the invention where provides a dynamic gamma correction method for online adjustment, including the following steps: receiving an image data (step 400); providing a single ramp voltage (step 410); generating a brightness-grayscale relationship curve based on the image data to calculate a plurality of gamma slopes for the regions (step 420); calculating a counter clock of non-uniform frequency clocks based on each gamma slope (step 430); and correcting a brightness-voltage non linear relationship based on the ramp voltage and the counter clock (step 440).

Figure 4B:
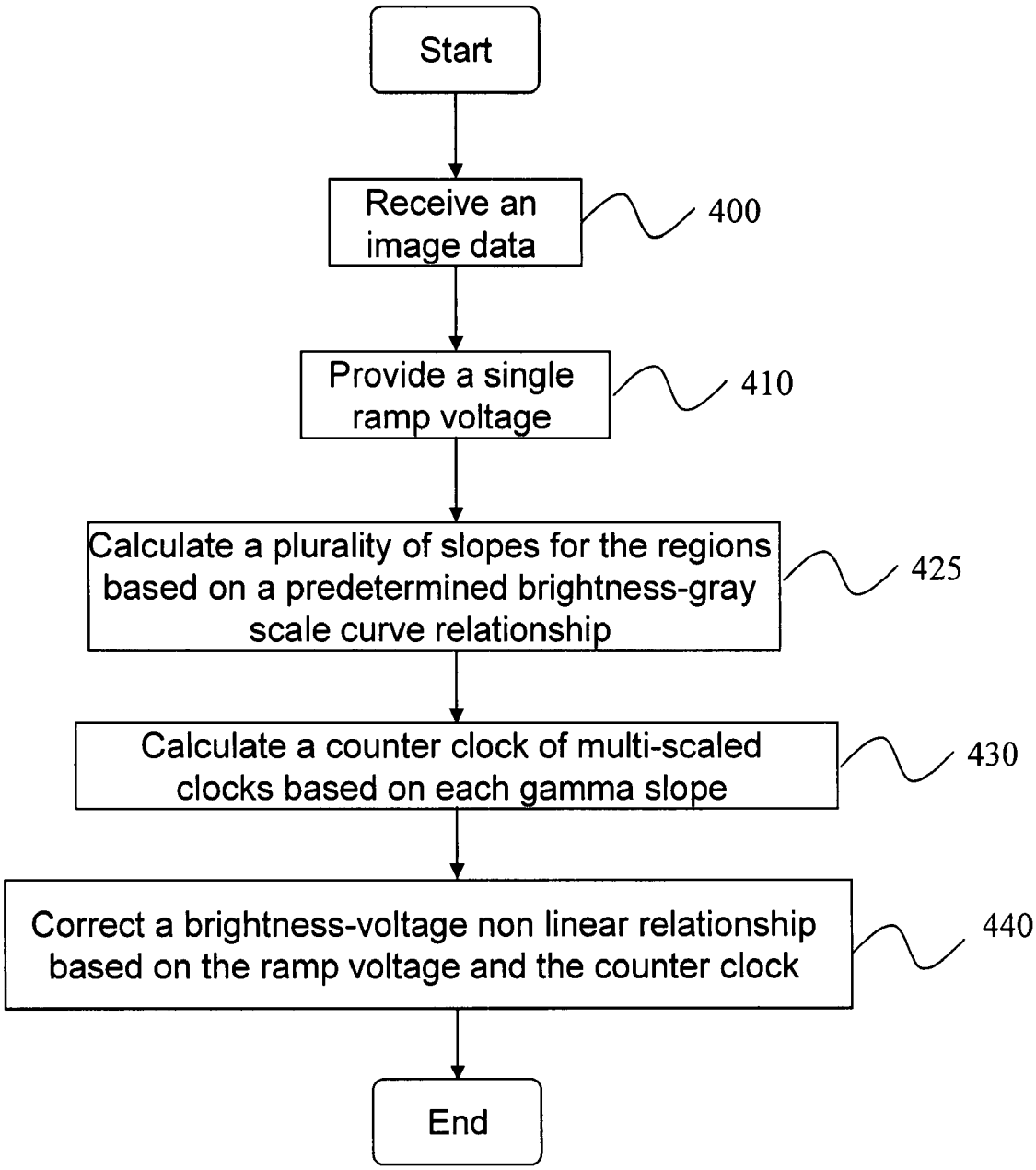
FIG. 4B shows a second embodiment of the method of the invention.

FIG. 4B shows a second embodiment of the invention where provides a dynamic gamma correction method for offline adjustment, including the following steps: receiving an image data (step 400); providing a single ramp voltage (step 410); calculating a plurality of slopes for the regions based on a predetermined brightness-grayscale curve relationship (step 425); calculating a counter clock of non-uniform frequency clocks based on each gamma slope (step 430); and correcting a brightness-voltage non linear relationship based on the ramp voltage and the counter clock (step 440).

Figure 5:
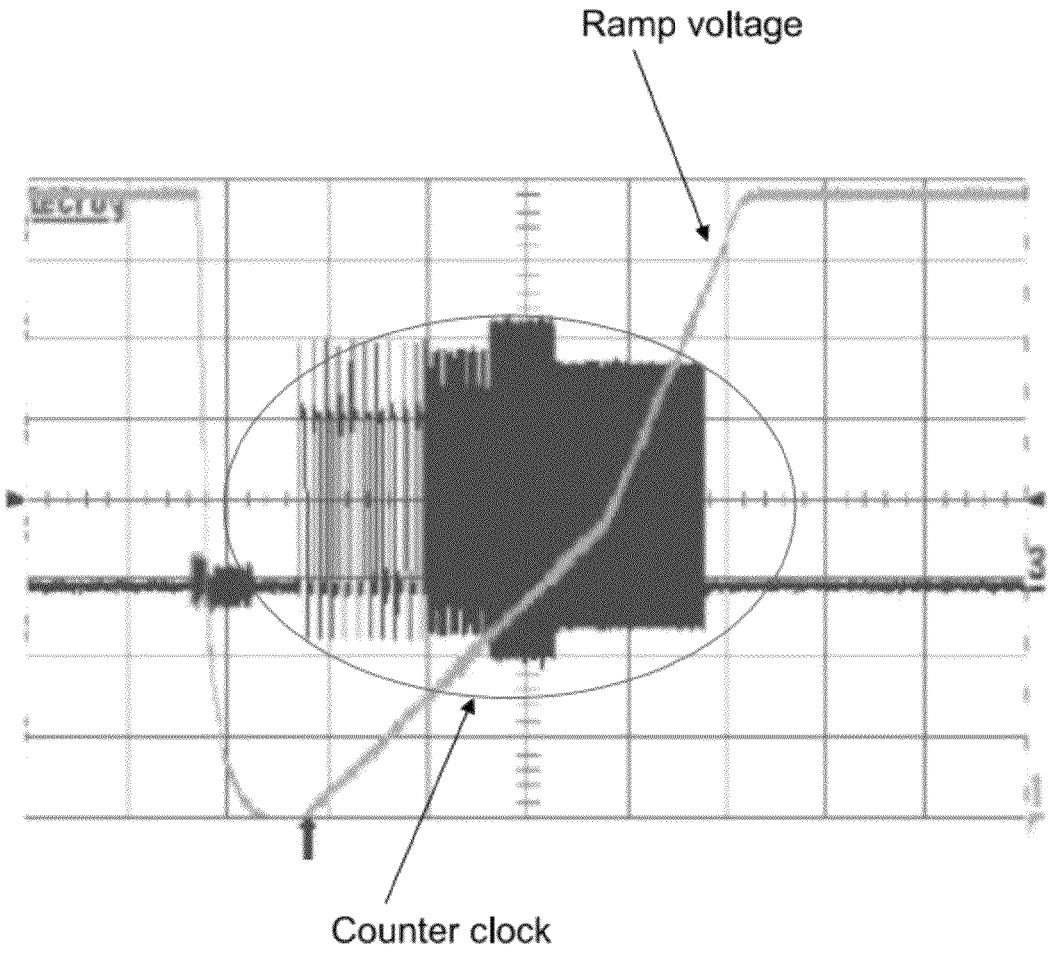
FIG. 5 is a diagram showing the ramp voltage for the dynamic gamma correction and the waveform of the counter clock.

FIG. 5 is a diagram showing the ramp voltage for the dynamic gamma correction and the waveform of the counter clock, which illustrates that the method for dynamic gamma correction of the invention is to control the grayscale by utilizing the single ramp voltage and the counter clock to undertake the multi frequency calculations automatically. Since the frequency is changeable and can be determined by the measured Brightness vs. Voltage in advance, an user can adjust it online, offline or depending on the image content. Because the frequency is unlimited, the linearity of the gamma curve can be infinitely increased.

Figure 6A:
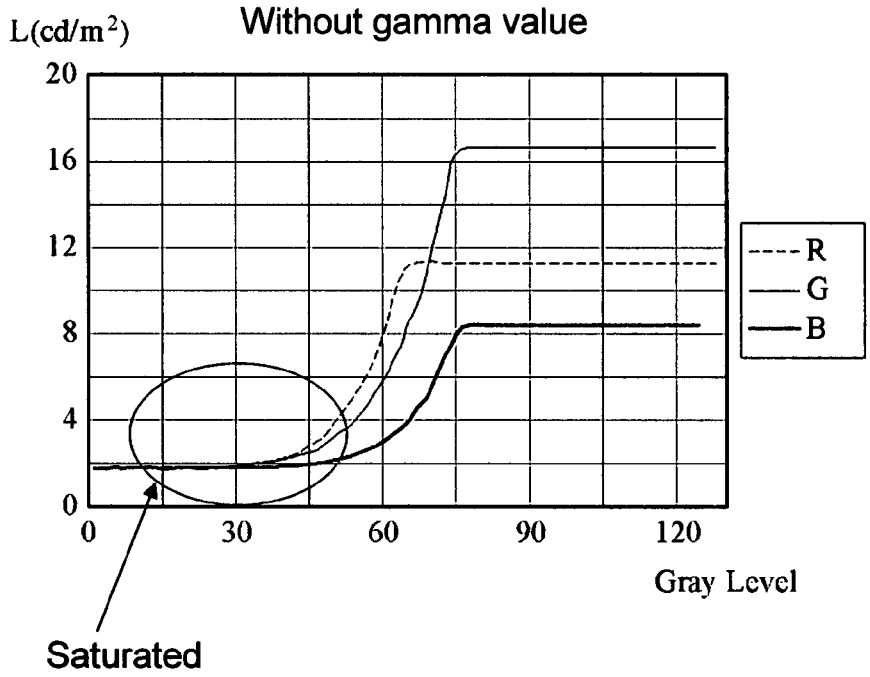
FIGS. 6A and 6B respectively show two diagrams of brightness-grayscale curve for different gamma corrections.
Figure 6B:
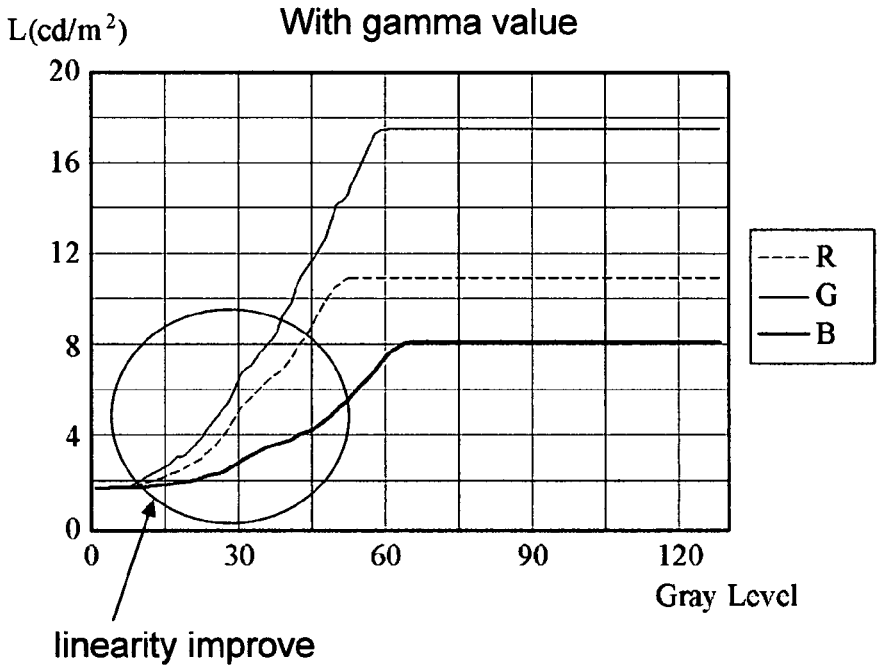

FIG. 6A and FIG. 6B show two diagrams of brightness-grayscale curve for different gamma corrections, where the diagram of FIG. 6B shows a gamma curve of non uniform scaled counter clock method for grayscale control and the diagram of FIG. 6A shows a gamma curve of uniform scaled counter clock method for grayscale control. In FIG. 6A, the counter clock curve for the grayscale control exhibits a bad exponent curve since low grayscale and high grayscale both are saturated and the amounts of grayscales become less therefore this gamma curve need to be adjusted. On the other hand, in FIG. 6B, the counter clock curve for the grayscale control can increase the linearity of the curve which will enhance the color performance.

Figure 7A:
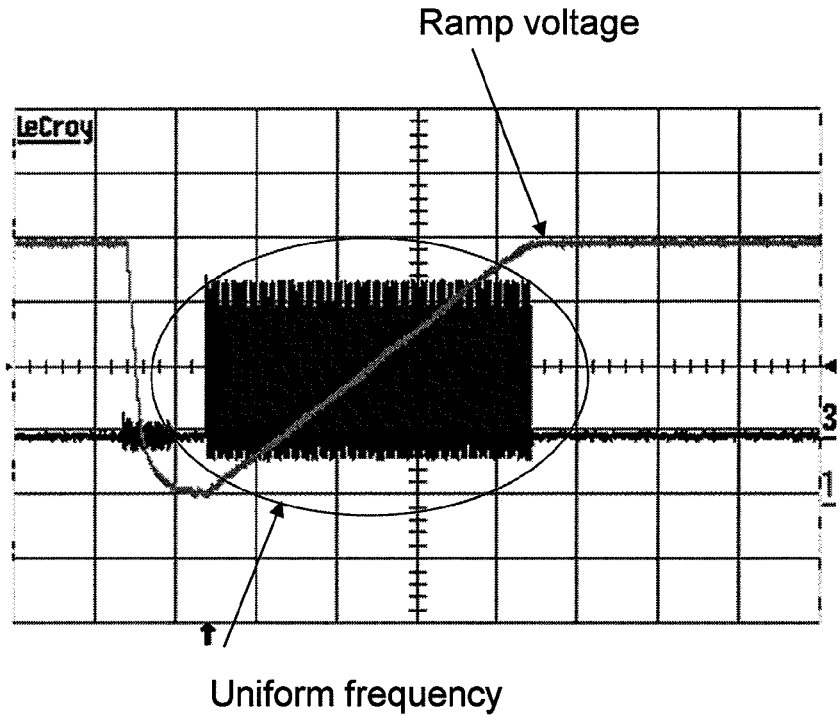
FIGS. 7A and 7B show two diagrams of brightness-grayscale curve for gamma correction which uses uniform counter clock.
Figure 7B:
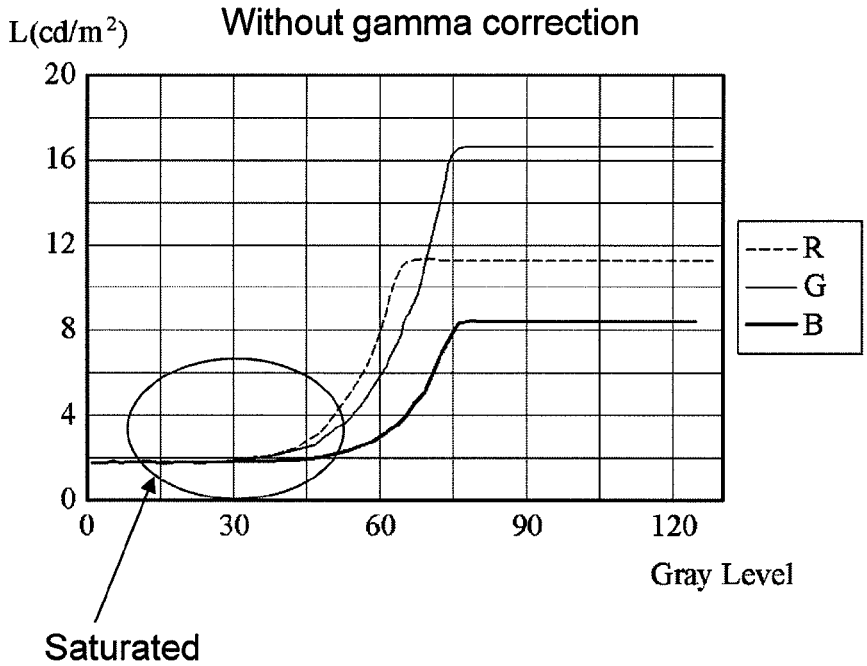

FIG. 7A and FIG. 7B shows diagrams of brightness-grayscale curve for gamma correction which use a uniform scaled clocks counter clock. The diagram in FIG. 7A uses a uniform scaled clocks counter clock to divide the ramp voltage (as shown in a circle and labeled 'Uniform frequency'), where the grayscale and gamma curve divided by the corresponding voltage need to be further corrected. The diagram in FIG. 7B shows the low grayscale and high grayscale exhibiting saturated.

Figure 8A:
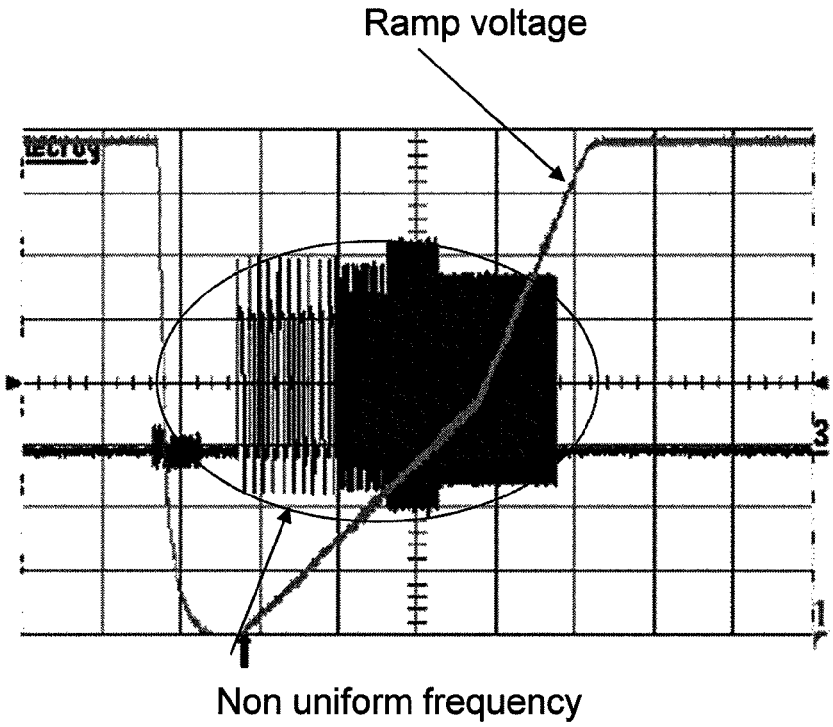
FIGS. 8A and 8B shows diagrams of brightness-grayscale curve for gamma correction which uses non uniform counter clock.
Figure 8B:
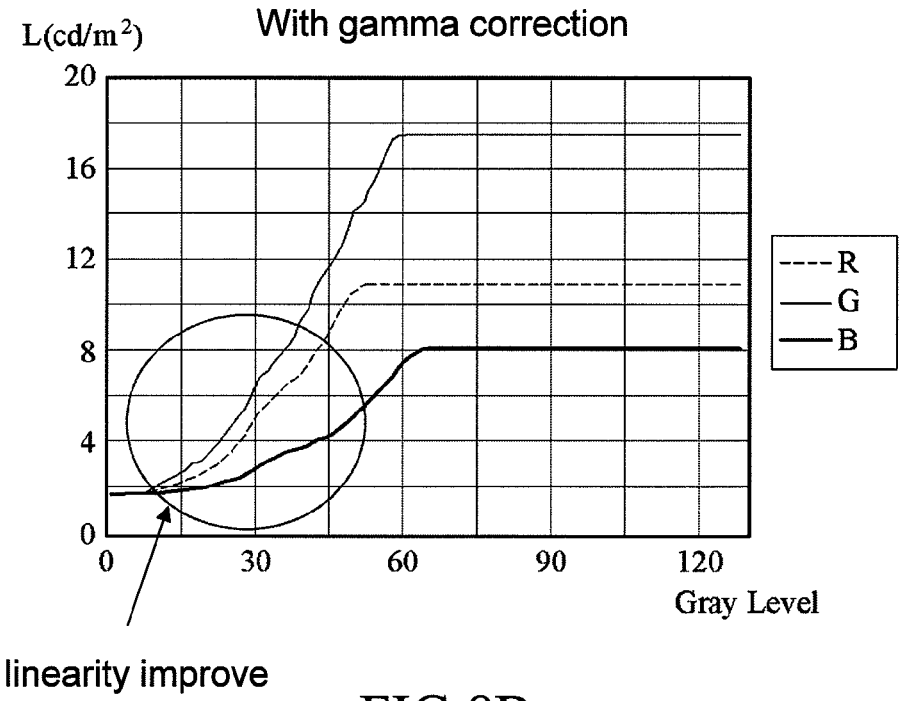

FIG. 8A and FIG. 8B show diagrams of brightness-grayscale curve for gamma correction which use a non uniform scaled clocks counter clock. The diagram in FIG. 8A uses a non uniform scaled clocks counter clock to divide the ramp voltage (as shown in a circle and labeled 'Non uniform frequency'), which corresponds to a more linear grayscale, shown in the diagram of FIG. 8B. Since the frequency of counter clock is proportional to the slope of the gamma curve, a higher slope needs a higher frequency so that the purpose of the gamma correction can be achieved. The formula is:

$$\text{Slope}=(H_h=H_1)/(G_h-G_1),\ \text{wherein } G \text{ is gray level, and } H \text{ is luminance.}$$

Formula for calculating the frequency includes:

All regions of counter clock is ΔT;

divides into n slopes, wherein each has a slope $\delta_n$;

$$\delta_1+\delta_2+\ldots+\delta_{n=1}+\delta_n=\delta_{Total};$$

wherein the counter clock is cc;

$$cc/\delta_{Total}\cong\Delta cc;$$

frequency $f_n$ for different regions are determined by:

$$\delta_1\times\Delta cc+\delta_2\times\Delta cc+\ldots+\delta_{n-1}\times\Delta cc+\delta_n\times\Delta cc=cc;$$

$$f1=\frac{\Delta T/n}{\delta_1\times\Delta cc};$$

$$f2=\frac{\Delta T/n}{\delta_2\times\Delta cc}\ldots;\ \text{and}$$

$$fn=\frac{\Delta T/n}{\delta_n\times\Delta cc}$$

Take all regions for the counter clock are 50000 pulses (ΔT), divided into 5 slopes and slopes are 1, 5, 10, 5, and 1 as an example, the $\delta_n$ will be 22 since 1+5+10+5+1=22. And if the counter clock is 128 pulses, the Δcc will be proximate to 6 since 128/22□6. Therefore, pulse slope $\delta_n\times\Delta cc$ for different regions is determined by:

$$6\times1+6\times5+6\times10+6\times5+6\times1.$$

This process can modify the pulse at the front region or at the back region or at the middle region to satisfy the total counter clock. Using the forgoing data as an example, the front region 6×1 and the back region 6×1 can both be decreased 2 pulses to 4, so that the total pulses will be 128. The formula above will then become:

$$4+30+60+30+4=128$$

So the frequency for every region will be:

f1=10000/4=2500 f2=10000/30=333 f3=10000/60=167 f4=10000/30=333 f5=10000/4=2500

Since the frequency for the counter clock is proportional to the slope of gamma curve, non-uniform frequency clocks counter clock for different regions can be obtained. Therefore the counter clock can exhibit different densities of waveform. For example, an ideal waveform will exhibit loose-dense-loose waveform to make low grayscale and high grayscale both linear, so that the linearity of the gamma curve can be infinitely increased.

While the illustrative embodiments of the invention have been set forth for the purpose of disclosure, modifications of the disclosed embodiments of the invention as well as other embodiments thereof may occur to those skilled in the art. Accordingly, the appended claims are intended to cover all embodiments, which do not depart from the spirit and scope of the invention.

What is claimed is:

1. A system for dynamic gamma correction of non-uniform frequency clocks, comprising:

a gamma slope calculation unit to receive an image data and depend on a brightness-grayscale relationship to numerically calculate a plurality of gamma slopes of a brightness-grayscale relationship for compensating an original gamma curves of a plurality of regions respectively; and a non-uniform frequency clocks counter clock calculation unit to calculate frequencies $f_n$ of a non-predetermined counter clock corresponding to each of the regions, based on each of the gamma slopes by formula:

$$fn=\frac{\Delta T/n}{\delta_1\times\Delta cc}\ \text{and}\ \frac{cc}{\delta_{Total}}\cong\Delta cc,$$

wherein ΔT is for all regions of the counter clock, n is number of the regions, $\delta_n$ is an inversed gamma slope of each of the regions, and cc is total pulses of the counter clock;

wherein a non-linear relationship of brightness-voltage for the image data of a display panel is corrected by input of a single ramp voltage and the counter clock.

2. The system as claimed in claim 1, wherein the system is burned into a field-programmable gate array (FPGA) or an application-specific integrated circuit (ASIC) by a mechanical description language.

3. The system as claimed in claim 1, wherein the display panel includes a liquid crystal display panel and a plasma display panel.

4. The system as claimed in claim 1, wherein the signal ramp voltage is generated by a ramp voltage generating circuit.

5. A method for dynamic gamma correction of non-uniform frequency clocks, comprising:

receiving an image data;

providing a single ramp voltage;

generating a brightness-grayscale relationship based on the image data to numerically calculate a plurality of gamma slopes of the brightness-grayscale relationship for compensating an original gamma curves of a plurality of regions respectively;

calculating frequencies $f_n$ of a non-predetermined counter clock corresponding to each of the regions, based on each of the gamma slopes by formula:

$$fn=\frac{\Delta T/n}{\delta_1\times\Delta cc}\ \text{and}\ \frac{cc}{\delta_{Total}}\cong\Delta cc,$$

wherein ΔT is for all regions of the counter clock, n is number of the regions, $\delta_n$ is an inversed gamma slope of each of the regions, and cc is total pulses of the counter clock; and correcting a brightness-voltage non-linear relationship for the image data of a display panel based on the single ramp voltage and the counter clock.

6. A method for dynamic gamma correction of non-uniform frequency clocks, comprising:

receiving an image data;

providing a single ramp voltage;

numerically calculating a plurality of gamma slopes of a predetermined brightness-grayscale relationship for compensating an original gamma curves of a plurality of regions respectively based on the predetermined brightness-grayscale relationship;

calculating frequencies $f_n$ of a non-predetermined counter clock corresponding to each of the regions, based on each of the gamma slopes by formula:

$$fn = \frac{\Delta T / n}{\delta_n \times \Delta cc} \text{ and } cc / \delta_{Total} \cong \Delta cc,$$

wherein ΔT is for all regions of the counter clock, n is number of the regions, $\delta_n$ is an inversed gamma slope of each of the regions, and cc is total pulses of the counter clock; and correcting a brightness-voltage non-linear relationship for the image data of a display panel based on the single ramp voltage and the counter clock.

* * * * *